US005472368A

United States Patent [19]

Zöllig

[11] Patent Number: 5,472,368

[45] Date of Patent: Dec. 5, 1995

[54] METHOD OF AND MACHINE FOR GRINDING CAMS

[75] Inventor: Günter Zöllig, Stuttgart, Germany

[73] Assignee: Schaudt Maschinenbau GmbH, Stuttgart, Germany

[21] Appl. No.: 149,455

[22] Filed: Nov. 9, 1993

[30] Foreign Application Priority Data

Nov. 21, 1992 [DE] Germany ..... 42 39 195.4

[51] Int. Cl.[6] ..... B42B 49/00; B42B 51/00

[52] U.S. Cl. ..... 451/8; 451/62

[58] Field of Search ..... 451/62, 296, 303, 451/304, 307, 11, 24, 8

[56] References Cited

U.S. PATENT DOCUMENTS

| | | | |
|---|---|---|---|
| 4,197,679 | 4/1980 | Yamada et al. | 451/62 |
| 4,833,834 | 5/1989 | Patterson | 51/147 |
| 4,885,874 | 12/1989 | Wedeniwski | 451/62 |
| 5,355,633 | 10/1994 | Ishikawa et al. | 451/62 |

FOREIGN PATENT DOCUMENTS

| | | | |
|---|---|---|---|
| 0085225 | 10/1983 | European Pat. Off. . | |
| 4029129A1 | 3/1992 | Germany . | |
| 4103091A1 | 6/1992 | Germany . | |
| 232760 | 12/1984 | Japan | 451/62 |
| 63-185564 | 8/1988 | Japan . | |
| 1569484 | 6/1980 | United Kingdom . | |
| 1596635 | 8/1981 | United Kingdom . | |
| 2233586 | 1/1991 | United Kingdom . | |

OTHER PUBLICATIONS

Wedeniwski, Horst Josef, "Prozessrechnergesteuertes Produktions–Nockenschleifen", Werksstatt Und Betrieb 118 (1985)8, pp. 443–448 .

*Primary Examiner*—Bruce M. Kisliuk
*Assistant Examiner*—Derris H. Banks
*Attorney, Agent, or Firm*—Darby & Darby

[57] ABSTRACT

Two or more angularly offset cams on a camshaft are ground simultaneously by discrete abrasive belts or grinding wheels while the camshaft rotates about its longitudinal axis. The camshaft is rotated in accordance with a pattern denoting different speeds during different stages of each revolution of the camshaft, and such pattern is selected in dependency on angular positions of the cams. Each belt or grinding wheel is movable radially of the axis of the rotating camshaft independently of the other belt(s) or wheel(s). The RPM of the camshaft is lower when one or more belts or wheels are in the process of grinding the flanks of the respective cam or cams, and the RPM is higher when one or more belts or wheels are in the process of grinding the apex or apices and/or the rounded portion or portions of the respective cam or cams. During each stage of each of its revolutions, the RPM of the camshaft matches or approximates the lowest of the maximum permissible RPMs for the momentary stage of rotation of the camshaft.

26 Claims, 4 Drawing Sheets

Fig.2
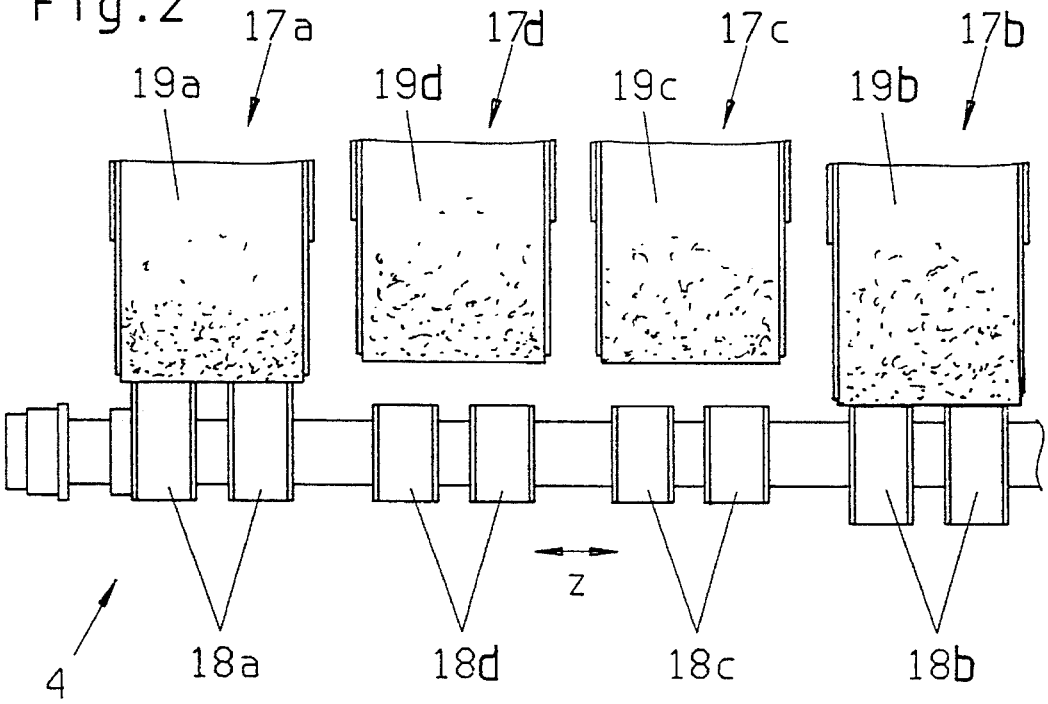
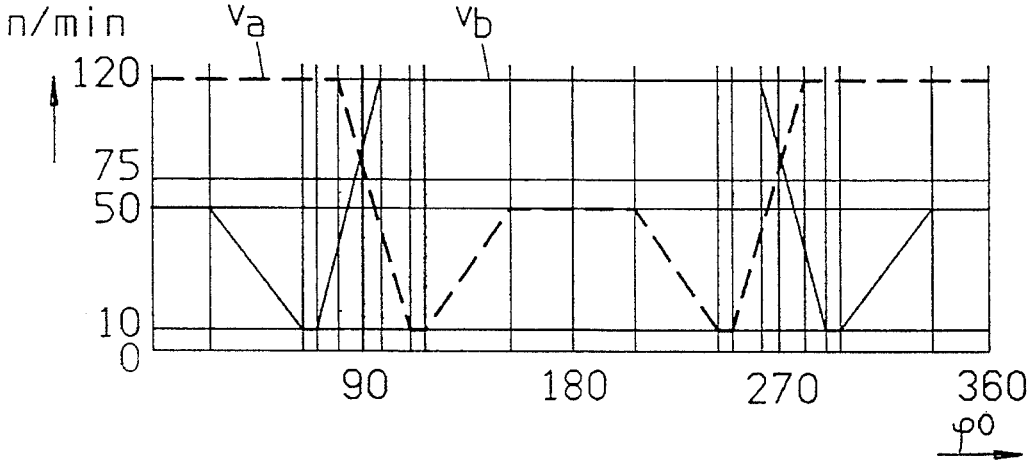
Fig.3

Fig.5
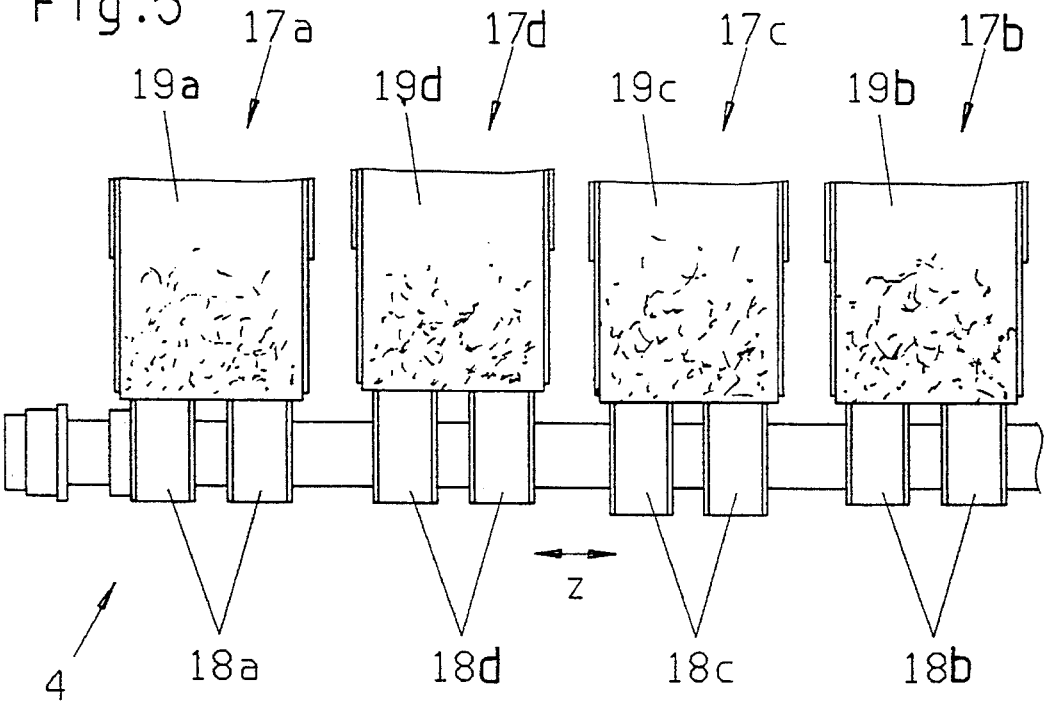
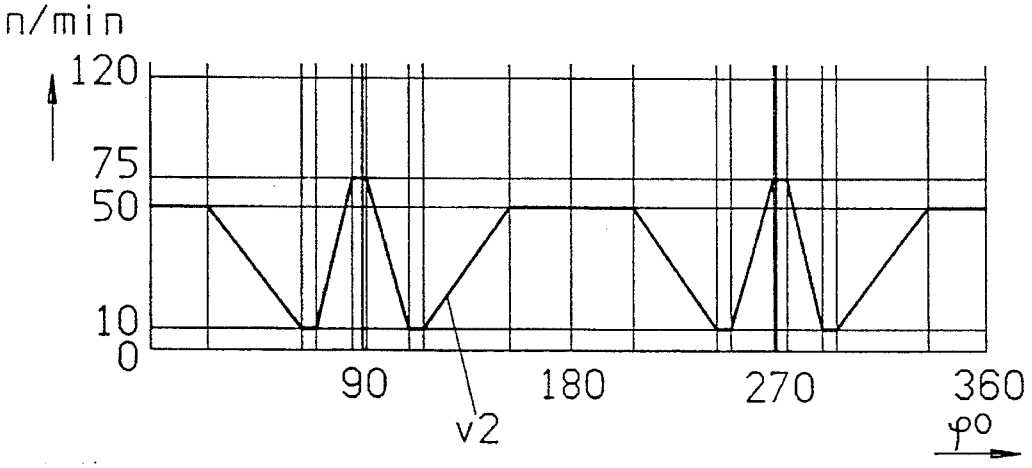
Fig.4

METHOD OF AND MACHINE FOR GRINDING CAMS

CROSS-REFERENCE TO RELATED CASE

The method and machine of the present invention are related to the method and apparatus disclosed in commonly owned copending patent application Ser. No. 08/138,496, filed 15 Oct., 1993 by Heinrich MUSHARDT for "Method and apparatus for the grinding of non-round tools".

BACKGROUND OF THE INVENTION

The invention relates to improvements in methods of and in apparatus or machines for grinding the exposed surfaces of protuberances on rotary workpieces, particularly for grinding the exposed surfaces of out-of-round portions (such as cams or cam lobes) of elongated rotary workpieces in the form of camshafts or the like. For the sake of simplicity, the following description will refer, primarily or exclusively, to protuberances in the form of cams and to workpieces in the form of camshafts. It is to be understood, however, that the invention can be practiced with equal or similar advantage for the grinding of protuberances other than cams or cam lobes on elongated camshafts.

It is well known to grind the cams of a camshaft by rotating the camshaft about its longitudinal axis and by moving a grinding implement, such as an endless abrasive belt or a grinding wheel, radially of and toward the peripheral surface of a cam on the rotating camshaft. The extent of movement of the implement toward the axis of the rotating camshaft determines the quantity of material which is removed from, and hence the ultimate shape or contour of, the treated cam. The machine which is used for the practice of such conventional grinding method employs a work holder which is normally provided with a headstock and a tailstock for the end portions of the camshaft to be treated, and the machine uses a motor or the like to rotate the properly held workpiece about its longitudinal axis. The material removing implement of the tool in such conventional grinding machine is or can be an endless abrasive belt which is caused to perform a circulatory movement, or a grinding wheel which is driven to rotate about its own axis during material removing engagement with the peripheral surface of a single cam or with the peripheral surface of a selected cam on the rotating camshaft. The base or bed of the grinding machine is provided with guides in the form of ways, tracks or rails which confine the tool to movements substantially radially of the axis of the rotating camshaft. The motor which serves to move the tool along the guide means is controlled, numerically or otherwise, to ensure that the wheel or the belt will remove a requisite quantity of material from the rotating cam, i.e., to ensure that the finished cam will assume a desired contour such as is necessary when the camshaft is used in a motor vehicle to control the movements of valves or for any other purpose where the cam or cams of the camshaft must control the movements of one or more followers or like parts with a high or very high degree of accuracy.

Certain presently known grinding machines employ relatively large grinding wheels which are driven to rotate about their own axes and are simultaneously moved radially or substantially radially of the axis of the rotating workpiece to remove material from the periphery of a cam. The angular movements of the rotating camshaft are synchronized with radial movements of the grinding wheel to thus ensure that the rate of material removal from different portions of a cam blank takes place with a view to produce a finished cam whose contour matches a desired or required configuration.

German patent application Serial No. 40 29 129 A1 of Eckert (published Mar. 3, 1992) discloses a grinding machine wherein a cam of the rotating camshaft is treated by an endless flexible abrasive belt mounted on a carriage for movement radially of the axis of the camshaft which is supported in a holder on the base of the machine frame. An advantage of the grinding machine of Eckert is that its belt can remove material from concave (receding) portions of peripheral surfaces of cams on the rotating camshaft.

A drawback of conventional methods and machines, irrespective of whether they employ material removing implements in the form of grinding wheels or abrasive belts, is that their operation is reasonably economical (i.e., that they can finish a relatively large number of camshafts per unit of time) only as long as they are called upon to grind a single cam at a time. Furthermore, the rate of material removal from a single cam also depends upon a number of additional factors such as the nature of the material of the cam, the characteristics of the material removing implement which is being used to carry out the grinding operation and/or the desired quality of the finished cam, i.e., the finish of the peripheral surface as well as the extent of deviation of the ultimate contour from an optimal or ideal contour. At any rate, even if a conventional machine is designed to grind a single cam at a time, its output cannot be increased at will even if all of the aforediscussed requirements (including the desired quality of the ultimate product, the material of the workpiece and the characteristics of the material removing implement) are fully met. The situation is further aggravated if a conventional machine is to be used to simultaneously treat two or more cams on a common camshaft, especially if the cams are angularly offset relative to each other in the direction of rotation of the camshaft about its longitudinal axis. Machines of such character are disclosed, for example, in U.S. Pat. No. 4,833,834 (granted May 30, 1989 to Patterson et al. for "Camshaft belt grinder") and in U.S. Pat. No. 4,945,683 (granted Aug. 7, 1990 to Phillips for "Abrasive belt grinding machine"). The disclosures of all of the above enumerated publications are incorporated herein by reference.

OBJECTS OF THE INVENTION

An object of the invention is to provide a method which renders it possible to simultaneously grind two or more protuberances which are provided on an elongated workpiece and which are treated while the workpiece rotates about its longitudinal axis.

Another object of the invention is to provide a novel and improved method of simultaneously grinding two or more axially spaced apart cams on a rotating camshaft.

A further object of the invention is to provide a method which can be practiced for removal of material from two or more one-piece cams or from two or more cams at least one of which is composed of two or more neighboring protuberances.

An additional object of the invention is to provide a method which renders it possible to shorten the intervals of simultaneous grinding of two or more cams or cam lobes on a rotating camshaft or an analogous workpiece.

Still another object of the invention is to provide a method which renders it possible to shorten the intervals of simultaneous grinding of two or more cams on a rotating workpiece without affecting the quality of the finish and/or the accuracy of configuration of the ultimate products.

A further object of the invention is to provide a machine which can be utilized for the practice of the above outlined method.

Another object of the invention is to provide the machine with novel and improved means for rotating and for regulating the rotation of the workpiece during removal of material from its cam or cams.

An additional object of the invention is to provide a novel and improved belt grinder for the cams of a camshaft which can be used in motor vehicles or elsewhere.

Still another object of the invention is to provide the above outlined grinding machine with novel and improved means for moving the material removing implements and the rotating workpiece relative to each other.

A further object of the invention is to provide a camshaft whose cams or analogous protuberances were treated in accordance with the above outlined method.

Another object of the invention is to provide a camshaft or an analogous workpiece whose cams or analogous protuberances were treated in the above outlined grinding machine.

SUMMARY OF THE INVENTION

One feature of the present invention resides in the provision of a method of grinding to a predetermined contour each of a plurality of cams which are spaced apart from each other in the direction of a longitudinal axis of an elongated rotary workpiece. The improved method comprises the steps of rotating the workpiece about the longitudinal axis, and establishing a relative movement between the workpiece and a grinding tool having a material removing implement for each of the cams to be ground. The step of establishing a relative movement includes moving each implement and the workpiece relative to each other, independently of movement of each other implement and the workpiece relative to one another, in a predetermined direction transversely of the longitudinal axis of the rotating workpiece. The moving step preferably includes moving each implement and the workpiece relative to each other at least substantially radially of the longitudinal axis of the workpiece. The workpiece can constitute an elongated camshaft having a plurality of cams at least some of which are angularly offset relative to each other as seen in the direction of rotation of the camshaft. The step of establishing the relative movement can include simultaneously moving the camshaft and at least two material removing implements relative to each other in the predetermined direction.

The rotating step can include rotating the workpiece about the longitudinal axis at different speeds during different stages of each revolution of the workpiece about its longitudinal axis. If the cams on the workpiece include at least two cams which are angularly offset with reference to each other in the direction of rotation of the workpiece about the longitudinal axis and each of the at least two cams is rotatable at a given maximum permissible speed during each of the aforementioned different stages of each revolution of the workpiece about its axis, the step of rotating the workpiece at different speeds can include rotating at least one of the at least two angularly offset cams at least close to the respective maximum permissible speed during each stage. The maximum permissible speed can vary from stage to stage, i.e., several times during each revolution of the workpiece about its axis.

In accordance with a presently preferred embodiment of the method, the step of rotating the workpiece at different speeds during different stages of each revolution of the workpiece can include establishing a predetermined pattern for the rotational speed of the workpiece during each of the aforementioned different stages of each revolution about the longitudinal axis. If the cams to be treated include at least two cams which are angularly offset relative to each other in the direction of rotation of the workpiece about its axis, and if each of the at least two cams is rotatable at a different maximum permissible speed during each of the aforementioned different stages of each revolution of the workpiece about its axis, the predetermined pattern can be composed of sections denoting the maximum permissible speed of at least one of the at least two cams in each angular position of the rotating workpiece. More specifically, the step of establishing a predetermined pattern for the rotational speed of the workpiece can include establishing a discrete pattern for at least two cams which form part of the aforementioned plurality of cams to be ground and are phase shifted relative to each other in the direction of rotation of the workpiece about its axis, and superimposing the discrete patterns to thus establish the predetermined pattern according to which the rotational speed of the workpiece varies as a function of phase shift of the at least two cams relative to each other. Each of the discrete patterns can denote maximum permissible rotational speeds of the respective cam (a) during the different stages of each revolution of the workpiece and (b) as a function of at least one predetermined parameter. Each of the at least two cams can be designed in such a way that it is rotatable at a different maximum permissible speed (than the other of these two cams) during at least some of the different stages of each revolution of the workpiece about its axis; the predetermined pattern can be selected to denote the lower of the maximum permissible speeds of the at least two cams during the at least some different stages of each revolution of the workpiece.

At least one of the material removing implements can include an endless abrasive belt.

Alternatively, at least one of the material removing implements can include a grinding wheel.

At least one cam of the aforementioned plurality of cams can constitute a composite cam having two at least substantially identical sections which are adjacent one another in the direction of the longitudinal axis of the workpiece. The step of establishing a relative movement in connection with the treatment of such workpieces can include utilizing a single material removing implement for each cam to be ground, i.e., also for the composite cam.

The method can also comprise the step of establishing a path for movements of the workpiece in the direction of its longitudinal axis.

Another feature of the present invention resides in the provision of a machine or apparatus for grinding to a predetermined contour each of a plurality of cams which are spaced apart from one another in the direction of a longitudinal axis of an elongated rotary workpiece, such as a camshaft having at least two cams which are angularly offset relative to each other as seen in the direction of rotation of the workpiece. The improved machine comprises a holder for the workpiece, means for rotating the workpiece in the holder about the longitudinal axis of the workpiece, a grinding tool including a discrete material removing implement for each cam to be ground (e.g., for each cam of the workpiece which is installed in the holder), and means for establishing a relative movement of the rotating workpiece and each of the implements in a direction transversely of the longitudinal axis of the workpiece in the holder. The means for establishing such relative movement includes means for establishing for each implement a relative movement independently of each other implement.

The tool can further comprise a support for the implements, and means for moving the implements relative to the support.

The tool can further comprise guide means for each of the implements and means for moving the implements relative to the respective guide means. The guide means preferably extend at least substantially radially of the axis of the workpiece in the holder. The means for establishing a relative movement for each of the implements can include a common control circuit for all of the implements.

The means for rotating the workpiece can include means for driving the workpiece in the holder at different speeds during different stages of each revolution of the workpiece about its longitudinal axis as a function of angular positions of the cams to be ground during the respective stages. If the machine is used for the grinding of a plurality of cams which are angularly offset relative to each other in the direction of rotation of the workpiece in the holder and which are rotatable at different maximum permissible speeds during such different stages of each revolution of the workpiece, the driving means can include means for regulating the angular speed of the workpiece in the holder during each revolution of the workpiece in accordance with a predetermined pattern which is a function of the maximum permissible rotational speeds of the plurality of cams during the different stages of each revolution of the workpiece. The arrangement is preferably such that the predetermined pattern is selected as a function of the lowest of the maximum permissible speeds of the plurality of cams to be ground during the different stages of each revolution of the workpiece in the holder about its axis.

At least one of the implements can include an endless abrasive belt. The arrangement can be such that at least two implements comprise or constitute abrasive belts and the belts are disposed next to each other as seen in the direction of the longitudinal axis of the workpiece in the holder.

The tool can comprise a plurality of grinding units each of which comprises, among others, one of the material removing implements and each of which is movable (e.g., in its entirety) relative to the holder substantially radially of the longitudinal axis of the workpiece in the holder.

If at least one of the implements comprises an endless abrasive belt, the respective unit of the tool preferably further comprises a back support which is movable substantially radially of the longitudinal axis of the workpiece in the holder to urge the belt against one of the plurality of cams forming part of the workpiece. If at least two implements comprise abrasive belts and back supports for such belts, the means for establishing the relative movement can include means for moving the back supports independently of each other.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain presently preferred specific embodiments with reference to the accompanying drawings.

BRIEF DESCRIPTION OF THE DRAWINGS

FIG. 2 is an enlarged plan view of a portion of a machine which is designed to simultaneously grind two, three or four angularly offset cams on a rotating camshaft, two of a total of four material removing implements being shown in contact with the adjacent cams;

FIG. 3 is a diagram with curves denoting the maximum permissible rotational speeds of two of the cams on the camshaft of FIG. 2 during different stages of each revolution of the camshaft;

FIG. 4 is a similar diagram wherein the curve denotes the novel RPM pattern for the camshaft during treatment of the two cams by the respective material removing implements;

FIG. 5 is a plan view similar to that of FIG. 2 but showing each of a total of four cams in contact with the adjacent material removing implement.

DESCRIPTION OF PREFERRED EMBODIMENTS

Figure 1:
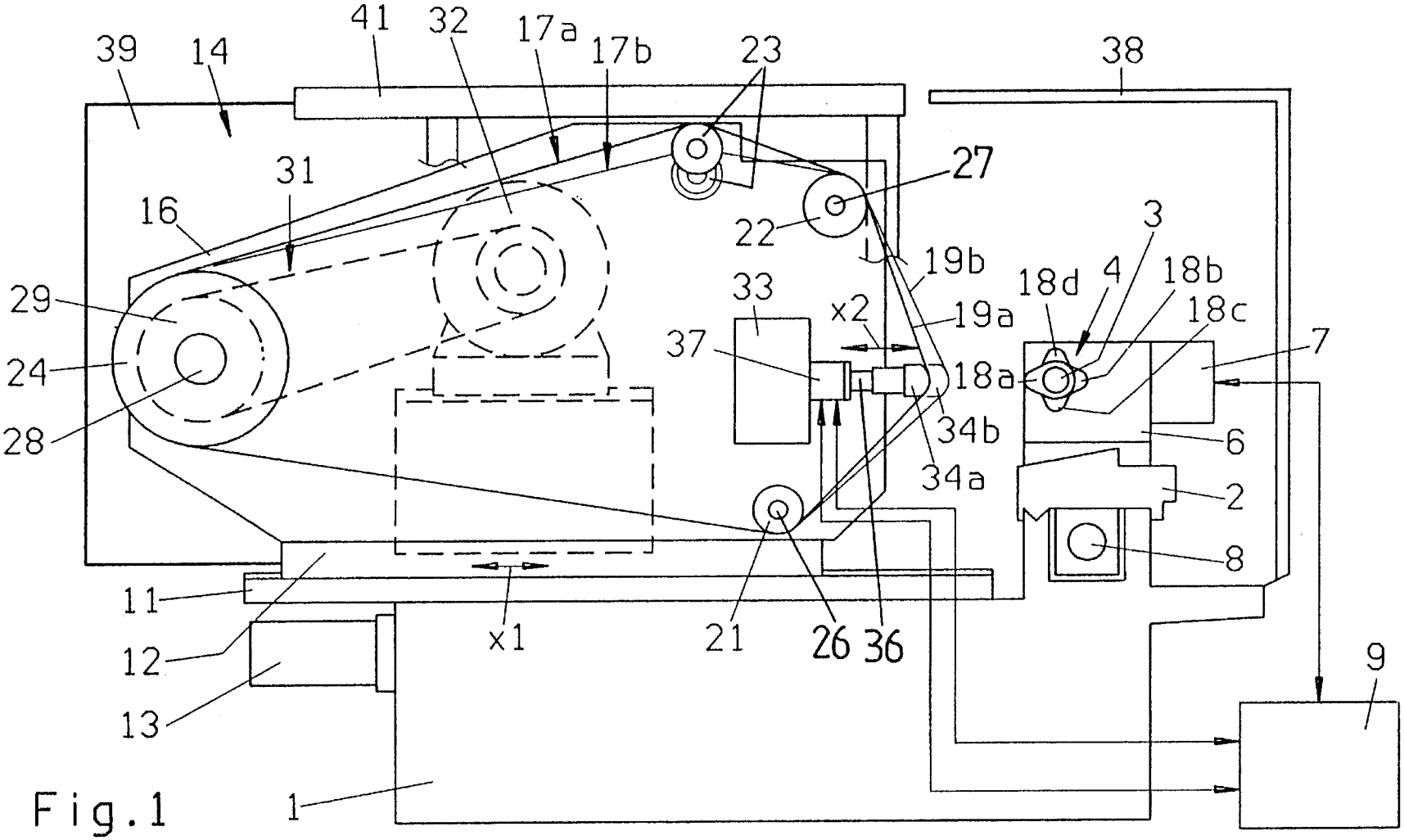
FIG. 1 is a fragmentary schematic elevational view of a grinding machine which embodies the present invention.

Referring first to FIG. 1, there is shown a portion of a grinding machine which embodies one form of the present invention. The machine comprises a base or bed 1 for a work holder 2 in the form of a table which is mounted for movement in the direction of the longitudinal axis 3 of an elongated workpiece 4 here shown as a camshaft with four out-of-round protuberances in the form of cams or cam lobes 18*a*, 18*b*, 18*c*, 18*d* (hereinafter and in the claims called cams for short). The means for releasably securing the camshaft 4 to the holder 2 for rotation about the longitudinal axis 3 (also called C-axis) includes a headstock 6, a tailstock (not specifically shown) and, if necessary, one or more customary steady rests, not shown.

The means for rotating a properly held camshaft 4 about its longitudinal axis 3 at a plurality of different speeds includes a variable-speed electric motor 7 or any other suitable prime mover whose speed can be regulated by a regulating unit 9 here shown as a control circuit to be described in greater detail hereinafter.

The means for moving (when necessary) the holder 2 in the direction of the axis 3 comprises a prime mover which rotates a feed screw 8 mating with a suitable nut (not shown) on or in the holder 2. The movements of the holder 2 under the action of the feed screw 8 (toward or away from the observer of FIG. 1) take place in the direction of the Z-axis (FIG. 2) of the grinding machine. The prime mover which includes the feed screw 8 receives signals from the control circuit 9. Movements of the holder 2 in parallelism with the axis 3 of the camshaft 4 therein are necessary in order to move the cam 18*a*, 18*b*, 18*c* and/or 18*d* into proper position for treatment by a tool including four discrete grinding units 17*a*, 17*b*, 17*c*, 17*d* respectively having discrete material removing implements 19*a*, 19*b*, 19*c*, 19*d* in the form of endless abrasive belts. The units 17*a*–17*d* of the grinding tool are mounted on a carriage or support 12 which is reciprocable along guide means 11 (e.g., in the form of ways, rails or tracks) provided therefor on the machine base 1. The directions of movement of the carriage 12 along the guide means 11 are indicated by a double-headed arrow X1, and such movements take place transversely of the longitudinal axis 3 of a camshaft 4 which is properly installed in the holder 2, preferably radially of such axis. The means for effecting relative movements of the properly installed camshaft 4 and the carriage 12 for the units 17*a*–17*d* with reference to one another (in the grinding machine of FIG. 1, such relative movements involve movements of the carriage 12 along the guide means 11) includes a suitable prime mover 13 (e.g., a variable-speed reversible electric motor) which receives signals from the control circuit 9. The exact nature of the transmission (not shown) between the carriage or support 12 and the prime mover 13 forms no part of the present invention.

The carriage 12 is provided with a tool supporting device 14 including an upright plate-like carrier 16 for the units 17*a*–17*d*. The axis 3 of a properly mounted camshaft 4 is assumed to be horizontal and the plane of the carrier 16 is assumed to be vertical and to extend at right angles to the axis 3. The plate-like carrier 16 constitutes but one form of the means for directly supporting the units 17*a*–17*d* of the composite grinding tool in the machine of FIG. 1. The number of units forming part of the composite grinding tool can be increased above or reduced to less than four without departing from the spirit of the present invention. As a rule, or at least in many instances, the maximum number of grinding units on the carrier 16 will match the maximum number of cams on a camshaft 4 which is to be treated in the improved machine. FIG. 2 shows that each of the cams 18*a*–18*d* can constitute a composite cam having a plurality of discrete cams (e.g., two discrete cams) which are spaced apart from each other in the direction of the axis 3. The shape and orientation of each set of discrete cams constituting a composite cam 18*a*, 18*b*, 18*c* or 18*d* is or can be the same; however, the cams 18*a*–18*d* are not only offset relative to each other in the direction of the axis 3 but are also angularly offset or staggered relative to each other about such axis (i.e., in or counter to the direction of rotation of the camshaft 4 about the axis 3 under the action of the rotating means 7 when the grinding machine is in actual use).

FIG. 1 shows only two grinding tool units 17*a* and 17*b* for the sake of simplicity, i.e., the machine can further include the units 17*b* and 17*c* of FIG. 2 or FIG. 5. The endless abrasive belt 19*a* of the grinding tool unit 17*a* can simultaneously remove material from the two discrete cams of the composite cam 18*a*, the endless abrasive belt 19*b* of the grinding tool unit 17*b* can simultaneously remove material from the two discrete cams of the composite cam 18*b*, and so forth.

Each of the four illustrated abrasive belts 19*a*– 19*d* is trained over two idler pulleys 21, 22, around a mobile roller 23 which serves to equalize the lengths of the respective belts, and around a driver pulley 24. The idler pulleys 21 are mounted, with appropriate spacing in the direction of the axis 3, on a shaft 26 which is supported by the carrier 16, and the idler pulleys 22 are mounted (again with appropriate spacing in the direction of the axis 3) on a shaft 27 which is also mounted on the carrier 16. The shafts 26 and 27 are mounted at one side of the carrier 16 in overhung position, and the idler pulleys 21 and 22 are free to rotate about the axes of the respective shafts 26 and 27. The mutual spacing of the mobile rollers 23 in the direction of the axis 3 is the same as that of the idler pulleys 21 and 22, and the same holds true for the mutual spacing (again as seen in the direction of the axis 3) of the driver pulleys 24. The mobile rollers 23 are movable independently of each other transversely of the axis 3, and the grinding tool of the machine which is shown in FIG. 1 can further comprise (if necessary) one or more additional idler pulleys (not shown) for each of the abrasive belts 19*a*–19*d*.

All of the driver pulleys 24 are mounted on and can receive torque from a common driver shaft 28 which is rotatably journalled in the carrier 16 and receives torque from a variable-speed prime mover 32, e.g., an electric motor. The means for transmitting torque from the output element of the motor 32 to the shaft 28 comprises a toothed pulley 29 on the shaft 28 and an endless toothed band 31 which is trained over the pulley 29 and over a similar pulley on the output element of the motor 32. The driver pulleys 24 are mounted on the driver shaft 28 at one side, and the pulley 29 is mounted on the driver shaft 28 at the other side, of the carrier 16. The motor 32 is mounted on the carriage 12, the same as the carrier 16 of the tool supporting device 14. Thus, the carriage 12 can move the carrier 16 (and hence the units 17*a*–17*d*) in the directions of arrow X1 simultaneously with the motor 32 for the abrasive belts 19*a*–19*d*.

The carrier 16 further supports a tool head 33 which can be said to constitute or to resemble a beam mounted in overhung position on and extending from one side of the carrier, namely at the side of the abrasive belts 19*a*–19*d*. The head 33 is parallel to the axis 3 of a camshaft 4 which is properly mounted on the holder 2. The purpose of the head 33 is to support a set of four mobile anvils or back supports, one for each of the belts 19*a*–19*d*. The backs supports are spaced apart from each other in the direction of the axis 3. (FIG. 1 shows two back supports 34*a* and 34*b* for the belts 19*a* and 19*b*) and are movable independently of each other in directions which are indicated by a double-headed arrow X2, namely at least substantially radially of the axis 3 of a camshaft 4 in the holder 2, to urge the external surfaces of the respective belts 19*a*–19*d* against the peripheral surfaces of the adjoining cams 18*a*–18*d* (it being assumed that all four cams are being ground simultaneously as actually shown in FIG. 5).

Each of the four back supports is mounted at the front end of a support or center 36 which serves as a guide means and is movable in the directions of arrow X2 by a discrete prime mover 37. Each of these prime movers receives signals from the control circuit 9. The latter preferably constitutes or forms part of the regulating unit for the entire grinding machine embodying the structure of FIG. 1. The rate of material removal (by the belts 19*a*– 19*d*) from the cams 18*a*–18*d* depends on the selected positions of the centers 36 or the back supports, i.e., on the nature of signals which the control circuit 9 transmits to the respective prime movers 37. The manner in which the signals from a control circuit can be utilized to select the rate of material removal is well known from the art of numerically controlled grinding machines. The axial positions of the centers 36 for the abrasive belts 19*a*–19*d* are different during different stages of each revolution of the camshaft 4 in the holder 2, i.e., during actual treatment of one or more cams 18*a*– 18*d* by the respective grinding tool unit or units 17*a*–17*d*. Thus, the movements of the back supports in directions which are indicated by the double-headed arrow X2 are synchronized with rotational movement of the camshaft 4 about its longitudinal axis 3 in order to ensure that each of the treated cams will assume a desired contour.

FIG. 1 further shows a cover or shroud 38 for the treating area which accommodates the holder 2 and the properly mounted camshaft 4 as well as the adjacent portions of the abrasive belts 19*a*–19*d*. The character 39 denotes a housing which confines the tool supporting device 14 and the parts mounted on the carrier 16. The housing 39 is mounted on or in a frame 41.

As can be seen in FIG. 2, the cams 18*a* and 18*b* are angularly offset relative to each other about the axis 3 of the camshaft 4 by 180°. The cam 18*d* is angularly offset by 90° relative to the adjacent cam 18*a*, the cam 18*c* is angularly offset by 180° relative to the adjacent cam 18*d*, and the cam

18b is angularly offset by 90° relative to the adjacent cam 18c. As already mentioned above, each of the four illustrated composite cams 18a–18d is assumed to comprise two identical and identically oriented discrete protuberances or cams which are adjacent each other in the direction of the axis 3 of the camshaft 4. The cam 18a may but need not be identical with or similar to the cam 18b, 18c and/or 18d, the cam 18b can but need not be identical with the cam 18c and/or 18d, and the cam 18c may but need not be identical with the cam 18d.

When a (composite or discrete, i.e., one-piece) cam on a camshaft is to be ground in a conventional manner, it is customary to impart to each revolution of the cam an RPM profile which is selected with a view to ensure adequate treatment of each and every portion of the peripheral surface of the cam, i.e., to take into consideration the fact that a cam normally comprises or can comprise an apex or tip, a rounded portion whose center of curvature is or can be located on the longitudinal axis of the camshaft, and two so-called flanks which are disposed opposite each other between the apex and the rounded portion. An optimal or preferred RPM profile for the cam 18a of FIGS. 1 and 2 is denoted in the diagram of FIG. 3 by a curve $V_a$, and an optimum or preferred RPM profile for the treatment of the cam 18b of FIGS. 1 and 2 is shown in the diagram of FIG. 3, by a curve $V_b$. It is assumed that the starting angular position ($\phi$=0) for each of the cams 18a and 18b is located at the center of the rounded portion. If the rounded portion of the cam 18a extends along an arc of approximately 220° (from 250° to 110° during each revolution of the camshaft 4), if one of the two flanks extends between 110° and 115°, if the other flank extends between 245° and 250°, and if the apex is located at 180° (during the same revolution of the camshaft), the camshaft can be rotated at an elevated speed (e.g., 120 RPM) while the contact zone between the belt 19a and the peripheral surface of the cam 18a advances along an arc of 220°. However, the RPM must be drastically reduced (e.g., all the way to 10 RPM) while the contact zone between the belt 19a and the cam 18a moves along the one or the other flank (i.e., each time along an arc of approximately 5°), and the RPM can be increased well above 10 RPM, e.g., close to or even somewhat beyond 50 RPM, during treatment of the apex of the cam 18a. In other words, the RPM profile denoted by the curve $V_a$ is composed of sections which are indicative of a rather high RPM (approximately 120), of a medium RPM (approximately 50) and (twice) of a low RPM (e.g., 10).

In FIG. 1, the center of the rounded portion of the cam 18a is located at the three o'clock position of the camshaft 4, the apex is located at the nine o'lock position, and the two flanks are located at the 8 and 10 o'clock positions, respectively. In FIG. 2, the belt 19a is in the process of removing material from the apex of the cam 18a and the belt 19b is in the process of removing material from the center of rounded portion of the cam 18b.

The aforementioned pronounced fluctuations of RPM during different stages of each revolution of the camshaft 4 are necessary in order to ensure adequate grinding of each and every portion of the peripheral surface of the cam 18a. The RPM of the camshaft 4 which is shown in FIGS. 1 and 2 could have a profile corresponding to that denoted in FIG. 3 by the curve $V_a$ if the grinding machine were to treat only the cam 18a, i.e., if the units 17b–17d were omitted or removed or deactivated so that the belts 19b–19d could not touch the respective cams 18b–18d.

In accordance with the present invention, two or more cams of a camshaft are or can be treated simultaneously. For example, and as shown in FIGS. 1 and 2, the cam 18a can be treated by the abrasive belt 19a of the tool unit 17a while the cam 18b is being treated by the abrasive belt 19b of the unit 17b. Such simultaneous treatment of the cams 18a and 18b renders it impossible to rely exclusively on the RPM pattern (curve $V_a$) for the treatment of the cam 18a or on the RPM pattern (curve $V_b$) for the cam 18b. The reason is that the orientations of the cams 18a, 18b (as seen in or counter to the direction of rotation of the camshaft 4 about its longitudinal axis 3) are different (the phase shift is assumed to be 180°), i.e., the treatment of the rounded portion of the cam 18a must take place simultaneously with the treatment of the apex of the cam 18b and vice versa. This can be seen in FIG. 2. The relationship of the RPM patterns (denoted by the curves $V_a$ and $V_b$) for optimal treatment of the cams 18a and 18b can be seen in FIG. 3 wherein the number of revolutions per minute is measured along the ordinate and different stages of a revolution of the camshaft 4 are shown along the abscissa. It will be seen that optimal treatment of the cam 18a necessitates or permits a relatively high RPM of the camshaft 4 when the optimal treatment of the cam 18b permits or necessitates a relatively low RPM and vice versa.

It would be close at hand (and this is known in the art of simultaneously grinding two or more cams of a camshaft) to select the lower or lowermost of two or more maximum permissible rotational speeds for each and every stage of a revolution of the camshaft if two or more cams are to be treated in a simultaneous operation. Based on the afore-described example, the camshaft 4 could be rotated at 10 revolutions per minute in order to ensure that the momentary RPM will not exceed the maximum permissible value for proper treatment of any of the various different portions or sections of a cam. In other words, one would simply select the lowermost permissible RPM for the treatment of the cam 18a or 18b (whichever is lower) and drive the camshaft 4 (at a constant speed) accordingly. This would avoid damage to or unsatisfactory treatment of the plural cams; however, the interval (in minutes) for completion of simultaneous treatment of two or more cams would be relatively long, namely the total number of revolutions divided by ten.

In accordance with the present invention, the RPM pattern for the camshaft 4 is selected in such a way that it is indicative of the maximum permissible RPM in each angular position of the camshaft. In other words, it is not the lowest permissible RPM which is being adhered to in each and every angular position of the camshaft but rather the lowermost maximum permissible RPM of two or more different RPM values, depending on the total number of cams which are being treated in a simultaneous operation and on the number of cams whose orientation (as seen in the direction of rotation of the camshaft) is different.

FIG. 4 shows a curve V2 denoting an RPM profile which is obtained by superimposition of the RPM profiles $V_a$ and $V_b$ for the cams 18a and 18b. In other words, the curve V2 is plotted by taking into consideration that the orientation of the cam 18a differs from that of the cam 18b by 180°. As can be seen in FIG. 4, the maximum permissible RPM while the camshaft is in the process of completing the 0°–90° portion of a revolution is determined by the corresponding portion of the curve $V_b$ denoting the RPM profile of the cam 18b. Between 90° and 270°, the maximum permissible RPM is determined by the corresponding portion of the curve V, denoting the RPM profile of the cam 18a. In the region between 270° and 360° the curve denoting the maximum permissible RPM of the camshaft 4 follows the corresponding portion of the curve $V_b$ denoting the RPM profile of the cam 18b. It will be seen that the camshaft 4 can be rotated at 50 RPM during treatment of the rounded portions and apices of the cams 18*a*, 18*b* and that the camshaft is rotated at 10 RPM during treatment of the flanks on the cam 18*a* or 18*b*. This entails a substantial saving in time when compared with the conventional proposal of rotating the camshaft at a constant speed of 10 RPM irrespective of whether the material removing implements of the tool including the units 17*a*–17*d* are in the process of treating the rounded portions, the apices or the flanks of two or more cams having different orientations. Thus, the novel method renders it possible to shorten the treatment of cams on a camshaft without affecting the quality of treatment because the actual RPM of the camshaft does not exceed the maximum permissible RPM during any stage of a revolution of the camshaft about its axis 3. FIG. 4 shows that the combined length of intervals during which the camshaft is rotated at 10 RPM is but a minute fraction of the interval which is required to complete a full revolution, i.e., that the major part of each revolution of the camshaft involves rotation at a speed much higher than 10 RPM.

Figure 6:
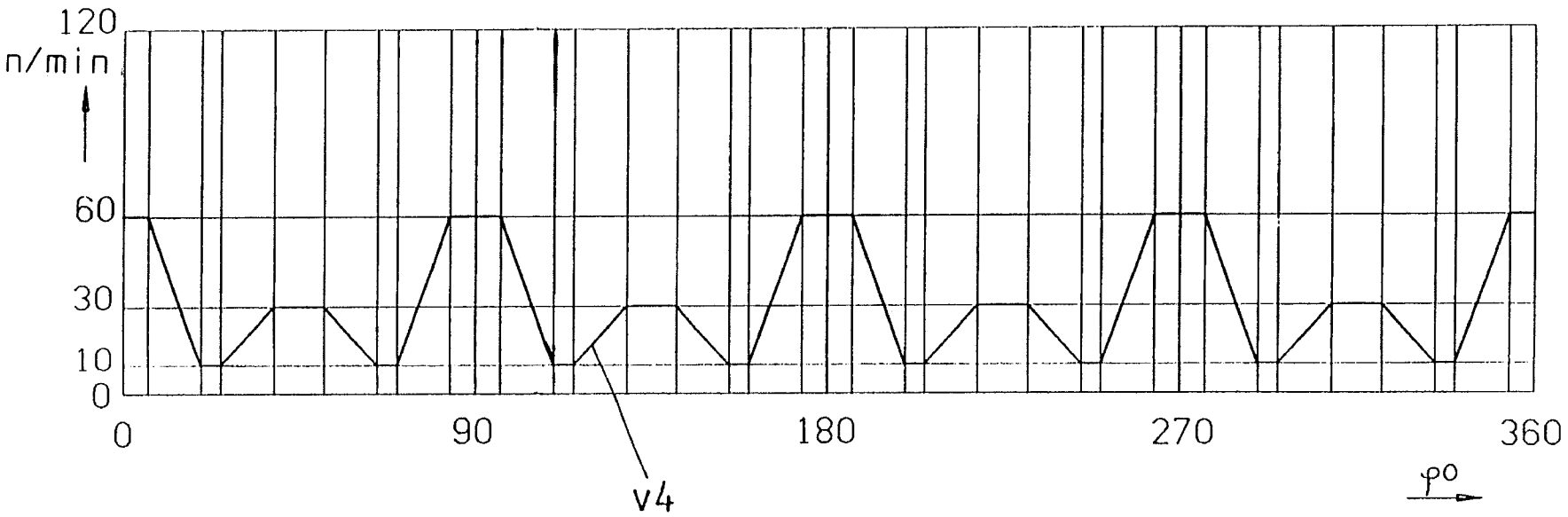
FIG. 6 is a diagram wherein the curve denotes the novel RPM pattern for each revolution of the camshaft whose cams are being treated in a manner as shown in FIG. 5.

FIG. 5 shows the camshaft 4 during simultaneous treatment of all four cams 18*a*–18*d* by the four discrete material removing implements (belts) 19*a*–19*d*, and a curve denoting the corresponding RPM profile of the camshaft during each of its revolutions is shown in the diagram of FIG. 6, as at V4. The belts 19*a*, 19*b* are in the process of removing material from the flanks of the respective cams 18*a*, 18*b*, the belt 19*d* is in the process of removing material from the apex of the cam 18*d*, and the belt 19*c* is in the process of removing material from the rounded portion of the cam 18*c*. The RPM profile curve V4 of FIG. 6 is obtained as a result of superimposition of four RPM profiles, one for each of the four cams 18*a*–18*d*, and by taking into consideration the differences in orientation of these cams (as seen in or counter to the direction of rotation of the camshaft 4). Again, the RPM profile curve V4 is composed of a number of portions or sections denoting the maximum permissible RPM during different stages of a full revolution of the camshaft 4. The profile curve V4 includes eight sections denoting 10 RPM (because the orientations of all four cams 18*a*–18*d* are assumed to be different and because each cam is assumed to have two flanks which should be treated only while the speed of the camshaft does not appreciably exceed 10 RPM. The duration of that portion of the interval of rotation of the camshaft 4 through 360° during which the RPM should not appreciably exceed 10 is but a minute fraction of the entire interval, i.e., a machine wherein the means for rotating the camshaft is set to vary the RPM) in accordance with the curve V4 of FIG. 6 can complete the treatment of all four cams within a minute fraction of the time which would be required if the camshaft were continuously rotated at or close to 10 RPM. In other words, the operation is much more economical than by following the heretofore known procedures, and the treatment of the four cams can be completed within a much shorter interval of time without in any way affecting the quality of the finished cams.

FIGS. 3, 4 and 6 show rather pronounced transitions between successive portions or sections of the curves $V_a$, $V_b$, V2 and V4 denoting the aforediscussed RPM patterns. In actual practice, the transition from a lower RPM to a higher RPM (or vice versa) during successive stages of a revolution of the camshaft 4 is more gradual, i.e., it is not possible (and often not advisable) to achieve very abrupt transitions from e.g., 10 RPM to a higher RPM or from 50 RPM to a lower RPM. In other words, successive sections of each of the curves $V_a$, $V_b$, V2 and V4 merge into each other gradually so that the corresponding portions are rounded rather than making a pronounced right angle or a pronounced oblique angle.

As already mentioned before, the method and machine of the present invention can be utilized for simultaneous treatment of two, three, four or more cams on a common camshaft, and the orientations of all such cams can but need not be different. The RPM pattern for rotation of the camshaft is selected accordingly, i.e., by taking into consideration the orientation of all of the cams and by selecting the maximum permissible RPM for each stage of each revolution of the camshaft. For example, the orientations of the four cams 18*a*–18*d* on the camshaft 4 of FIGS. 2 and 5 need not vary by 90° and the machine can be set up for simultaneous grinding of three of the thus oriented cams.

All embodiments of the improved method and machine share the advantage that the duration of the interval for completion of simultaneous treatment of two or more cams on a camshaft or an analogous rotary workpiece can be considerably reduced without affecting the quality of treatment. This is achieved in that the average RPM of the camshaft 4 is much higher than the lowermost permissible RPM. Thus, the average RPM which can be achieved by the camshaft 4 by following the pattern denoted by the curve V2 of FIG. 4 or by the curve V4 of FIG. 6 is well above 10 RPM which is assumed to be the maximum permissible RPM during treatment of a flank of one of two or more cams having different orientations.

The abrasive belts 19*a*–19*d* constitute but one form of material removing implements which can be used in the machine of the present invention. For example, one or more or all of these belts can be replaced with grinding wheels which are driven to rotate about their own axes while in material removing contact with the peripheral surface(s) of the adjacent cam(s). All that counts is to ensure that the relative movements of the workpiece and the material removing implements during different stages of each revolution of the workpiece be selected by following an RPM pattern corresponding to that denoted by the curve V2 of FIG. 4 or the curve V4 of FIG. 6.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of grinding to a predetermined contour each of a plurality of cams which are spaced apart from each other in the direction of a longitudinal axis of an elongated rotary workpiece, comprising the steps of rotating the workpiece about the longitudinal axis; and establishing a relative movement between the workpiece and a grinding tool having a material removing implement for each of the cams, including moving each implement and the workpiece relative to each other independently of each other implement and the workpiece in a predetermined direction transversely of the longitudinal axis of the rotating workpiece, said rotating step comprising rotating the workpiece about the longitudinal axis at different speeds during different stages of each revolution of the workpiece about said axis.

2. The method of claim 1, wherein said moving step includes moving each implement and the workpiece relative to each other at least substantially radially of the longitudinal axis of the workpiece.

3. The method of claim 1 of grinding an elongated camshaft having a plurality of cams at least some of which are angularly offset relative to each other in the direction of rotation of the camshaft, wherein said step of establishing said relative movement includes simultaneously moving the camshaft and at least two implements relative to each other in said predetermined direction.

4. The method of claim 1, wherein the cams include at least two cams which are angularly offset with reference to each other in the direction of rotation of the workpiece about said longitudinal axis and each of said cams is rotatable at a given maximum permissible speed during each of said different stages of each revolution of the workpiece about said axis, said step of rotating the workpiece at different speeds including rotating the cams during each of said stages simultaneously at least close to the maximum permissible speed of one of the cams.

5. The method of claim 1, wherein said step of rotating the workpiece at different speeds includes establishing a predetermined pattern for the rotational speed of the workpiece during each of said different stages of each revolution about said axis.

6. The method of claim 5, wherein the cams include at least two cams which are angularly offset with reference to each other in the direction of rotation of the workpiece about said axis and each of said at least two cams is rotatable at a different maximum permissible speed during each of said different stages of each revolution of the workpiece about said axis, said pattern being composed of sections denoting in each angular position of the rotating workpiece the respectively lowest permissible maximum speed.

7. The method of claim 5, wherein said step of establishing said predetermined pattern includes establishing discrete patterns for the rotational speeds of at least two cams forming part of said plurality of cams and being shifted in phase relative to each other in the direction of rotation of the workpiece about said axis, and superimposing the discrete patterns, taking into consideration the angular positions of said at least two cams relative to each other, to establish said predetermined pattern.

8. The method of claim 7, wherein each of said discrete patterns denotes maximum permissible rotational speeds of the respective cam (a) during said different stages of each revolution of the workpiece about said axis and (b) as a function of at least one predetermined parameter.

9. The method of claim 5, wherein at least two of said plurality of cams are angularly offset relative to each other in the direction of rotation of the workpiece about said axis and each of said at least two cams is rotatable at a different maximum permissible speed during at least some of said different stages of each revolution of the workpiece about said axis, said predetermined pattern denoting the lower of the maximum permissible speeds of said at least two cams during said at least some different stages of each revolution of the workpiece.

10. The method of claim 1, wherein at least one of the material removing implements includes an abrasive belt.

11. The method of claim 1 of grinding each of a plurality of cams wherein at least one of the cams is a composite cam having two at least substantially identical sections which are adjacent one another in the direction of said axis, said step of establishing a relative movement comprising utilizing a single material removing implement for each of the cams to be ground including the at least one composite cam.

12. The method of claim 1, further comprising the step of establishing a path for movements of the workpiece in the direction of said longitudinal axis.

13. A machine for grinding to a predetermined contour each of a plurality of cams which are spaced apart from each other in the direction of a longitudinal axis of an elongated rotary workpiece, comprising a holder for the workpiece; means for rotating the workpiece in the holder about the longitudinal axis; a grinding tool including a discrete material removing implement for each of the plurality of cams on the workpiece in the holder; and means for establishing a relative movement of the rotating workpiece and each of the implements in a direction transversely of the axis of the workpiece in the holder, including means for establishing for each implement a relative movement independently of at least one other implement, said means for rotating comprising means for driving the workpiece in the holder at different speeds during different stages of each revolution of the workpiece about its axis.

14. The machine of claim 13, wherein said tool further comprises a support for the implements and means for moving the implements relative to the support.

15. The machine of claim 13, wherein said tool further comprises guide means for each of said implements and means for moving said implements relative to the respective guide means, said guide means extending substantially radially of the axis of the workpiece in said holder.

16. The machine of claim 15, wherein said means for establishing a relative movement for each of said implements includes a common control circuit for all of said implements.

17. The machine of claim 13, wherein said means for rotating includes means for driving the workpiece in the holder at different speeds during different stages of each revolution of the workpiece about its axis as a function of angular positions of the cams during the respective stages.

18. The machine of claim 17 for grinding a plurality of cams which are angularly offset relative to each other in the direction of rotation of the workpiece in the holder and which are rotatable at different maximum permissible speeds during said different stages of each revolution of the workpiece, wherein said means for driving includes means for regulating the angular speed of the workpiece in the holder during each revolution of the workpiece in accordance with a predetermined pattern as a function of maximum permissible rotational speeds of said plurality of cams during said different stages of each revolution of the workpiece in the holder.

19. The machine of claim 18, wherein said pattern is a function of the lowest of said maximum permissible speeds of said plurality of cams during said different stages of each revolution of the workpiece in said holder.

20. The machine of claim 13, wherein at least one of said implements includes an abrasive belt.

21. The machine of claim 13, wherein at least two of said implements include abrasive belts, said belts being disposed next to each other in the direction of the longitudinal axis of the workpiece in said holder.

22. The machine of claim 13, wherein said tool includes a plurality of grinding units each of which includes one of said implements and each of which is movable relative to said holder substantially radially of the axis of the workpiece in the holder.

23. The machine of claim 13, wherein at least one of said implements includes an endless driven abrasive belt and a back support movable substantially radially of the axis of the workpiece in said holder to urge the belt against one of said plurality of cams.

24. The machine of claim 23, wherein at least two of said implements include belts and back supports, said means for establishing relative movement including means for moving said back supports independently of each other.

25. A method of grinding to a predetermined contour each of a plurality of cams which are spaced apart from each other in the direction of a longitudinal axis of an elongated rotary workpiece, comprising the steps of rotating the workpiece about the longitudinal axis; and establishing a relative movement between the workpiece and a grinding tool having a material removing implement for each of the cams, including moving each implement and the workpiece relative to each other independently of each other implement and the workpiece in a predetermined direction transversely of the longitudinal axis of the rotating workpiece, the cams being angularly offset relative to each other in the direction of rotation of the workpiece, and said step of establishing said relative movement comprising simultaneously moving the workpiece and at least two implements relative to each other in said predetermined direction, said rotating step including rotating the workpiece about the longitudinal axis at different speeds during different stages of each revolution of the workpiece about said axis, and said rotating step further including establishing discrete patterns for the rotational speeds of said cams such that each of said cams is rotatable at different maximum permissible speeds during different stages of each revolution of the workpiece about said axis, said rotating step additionally including rotating the cams during each stage at least close to the lowest maximum permissible speed corresponding to the respective stage.

26. A machine for grinding to a predetermined contour each of a plurality of cams which are spaced apart from each other in the direction of a longitudinal axis of an elongated rotary workpiece, comprising a holder for the workpiece; means for rotating the workpiece in the holder about the longitudinal axis; a grinding tool including a discrete material removing implement for each of the plurality of cams on the workpiece in the holder; and means for establishing a relative movement of the rotating workpiece and each of the implements in a direction transversely of the axis of the workpiece in the holder, including means for establishing for each implement a relative movement independently of at least one other implement, said cams being angularly offset relative to each other in the direction of rotation of the workpiece, and said means for establishing a relative movement comprising means for simultaneously moving at least two of said implements relative to each other in said direction, said means for rotating including means for driving the workpiece at different speeds during different stages of each revolution of the workpiece about its axis, and said cams being rotatable at different maximum permissible speeds during different stages of each revolution of the workpiece about its axis, said means for driving comprising means for regulating the angular speed of the workpiece so that the angular speed of the workpiece during each stage is at least close to the lowest maximum permissible speed corresponding to the respective stage.

* * * * *